US010160934B2

(12) United States Patent
Spill et al.

(10) Patent No.: US 10,160,934 B2
(45) Date of Patent: Dec. 25, 2018

(54) WASHING OR CLEANING AGENTS WITH ELECTROCHEMICALLY ACTIVATABLE ANIONIC MEDIATOR COMPOUNDS

(71) Applicant: Henkel AG & Co. KGaA, Duesseldorf (DE)

(72) Inventors: Iwona Spill, Berlin (DE); Mareile Job, Leverkusen (DE); Peter Schmiedel, Duesseldorf (DE); Thomas Gerke, Duesseldorf (DE); Guido Grundmeier, Wuerzburg (DE); Markus Voigt, Paderborn (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/332,018

(22) Filed: Oct. 24, 2016

(65) Prior Publication Data

US 2017/0037342 A1 Feb. 9, 2017

Related U.S. Application Data

(63) Continuation of application No. PCT/EP2015/057647, filed on Apr. 9, 2015.

(30) Foreign Application Priority Data

Apr. 24, 2014 (DE) ..... 10 2014 207 673

(51) Int. Cl.

| | |
|---|---|
| ***C11D 3/28*** | (2006.01) |
| ***C11D 11/00*** | (2006.01) |
| ***C11D 9/44*** | (2006.01) |
| ***C11D 7/32*** | (2006.01) |
| ***C11D 3/34*** | (2006.01) |
| ***C11D 7/34*** | (2006.01) |

(52) U.S. Cl.
CPC ..... *C11D 3/28* (2013.01); *C11D 3/349* (2013.01); *C11D 7/3281* (2013.01); *C11D 7/34* (2013.01); *C11D 9/446* (2013.01); *C11D 11/0017* (2013.01); *C11D 11/0023* (2013.01)

(58) Field of Classification Search
CPC .. C11D 9/446; C11D 11/0017; C11D 11/0023
See application file for complete search history.

(56) References Cited

U.S. PATENT DOCUMENTS

2013/0296544 A1* 11/2013 Isogai ..... D06M 11/34 536/56
2014/0143959 A1* 5/2014 Job ..... C11D 3/28 8/137

FOREIGN PATENT DOCUMENTS

| | | | |
|---|---|---|---|
| DE | 102011080099 | * | 1/2013 |
| EP | 0314630 A2 | | 5/1989 |
| GB | 1464427 | | 2/1977 |
| GB | 1473201 | | 5/1977 |
| GB | 1473202 | | 5/1977 |
| GB | 1473571 | | 5/1977 |

OTHER PUBLICATIONS

PCT International Search Report (PCT/EP2015/057647) dated Aug. 6, 2015.

* cited by examiner

*Primary Examiner* — Charles I Boyer
(74) *Attorney, Agent, or Firm* — Thomas G. Krivulka

(57) ABSTRACT

The aim of the invention is to improve the cleaning power of washing and cleaning agents, especially with regard to bleachable stains, while avoiding any damage to the textile treated with said washing and cleaning agents. This is substantially achieved by using an electrolytically bleachable species generated by a redox reaction from an anionically substituted 1-hydroxy-2,2,6,6-tetramethylpiperidine, 2,2,6,6-tetramethylpiperidine-N-oxide, or (2,2,6,6-tetramethylpiperidine-1-yl)oxyl.

5 Claims, No Drawings

WASHING OR CLEANING AGENTS WITH ELECTROCHEMICALLY ACTIVATABLE ANIONIC MEDIATOR COMPOUNDS

FIELD OF THE INVENTION

The present invention generally relates to the use of specific organic mediator compounds to boost the cleaning power of washing and cleaning agents with respect to stains, to washing or cleaning methods employing bleaching-active species generated from such mediator compounds, and to washing and cleaning agents that contain the mediator compound.

BACKGROUND OF THE INVENTION

Inorganic peroxygen compounds, in particular hydrogen peroxide and solid peroxygen compounds that dissolve in water with release of hydrogen peroxide, such as sodium perborate and sodium carbonate perhydrate, have been used for some time as oxidizing agents for disinfection and bleaching purposes. The oxidizing effect of these substances in dilute solutions depends greatly on temperature; thus, sufficiently rapid bleaching of stained textiles in alkaline bleaching baths is achieved, for example, with $H_2O_2$ or perborate only at temperatures above about 80° C. At lower temperatures, the oxidizing effect of the inorganic peroxygen compounds can be improved by the addition of so-called bleach activators, which are capable of affording peroxocarboxylic acids under the above-discussed perhydrolysis conditions and have become known in the literature for numerous proposals, chiefly from the substance classes of N- or O-acyl compounds, for example, reactive esters, polyacylated alkylenediamines, in particular N,N,N',N'-tetraacetylethylenediamine (TAED), acylated glycourils, in particular tetraacetylglycouril, N-acylated hydantoins, hydrazides, triazoles, hydrotriazines, urazoles, diketopiperazines, sulfurylamides, and cyanurates, also carboxylic acid anhydrides, in particular phthalic anhydride, carboxylic acid esters, in particular sodium nonanoyloxybenzenesulfonate (NOBS), sodium isononanoyloxybenzenesulfonate, O-acylated sugar derivatives such as pentaacetyl glucose, and N-acylated lactams, such as N-benzoylcaprolactam. The addition of these substances can increase the bleaching effect of aqueous peroxide baths so far that substantially the same effects that already occur at temperatures of around 60° C. occur as with the peroxide bath alone at 95° C.

In efforts to achieve energy-saving washing and bleaching methods, utilization temperatures still appreciably below 60° C., in particular below 45° C., down to cold water temperature have also become important in recent years.

The action of hitherto known activator compounds normally decreases perceptibly at these low temperatures. There has therefore been no lack of effort to develop more effective activators for this temperature range. The use of transition metal compounds, in particular transition metal complexes, to boost the oxidizing power of peroxygen compounds or also of atmospheric oxygen in washing and cleaning agents has also been proposed on various occasions. Transition metal compounds proposed for this purpose include, for example, salen complexes of manganese, iron, cobalt, ruthenium, or molybdenum, carbonyl complexes of manganese, iron, cobalt, ruthenium, or molybdenum, complexes of manganese, iron, cobalt, ruthenium, molybdenum, titanium, vanadium, and copper with nitrogen-containing tripod ligands, and manganese complexes with polyazacycloalkane ligands, such as TACN. A disadvantage of such metal complexes, however, is either that they possess in part a bleaching power that is insufficient especially at a lower temperature, or, if they have sufficient bleaching power, that undesired damage can occur to the colors of the material that is to be washed or cleaned, and if applicable even to the material itself, for example, the textile fibers.

It is known from the international patent application WO 2013/017476 A1 that bleaching-active species that have a bleach-intensifying effect can be generated from sterically hindered N-hydroxy compounds such as, for example, 1-hydroxy-2,2,6,6-tetramethylpiperidine by electrolysis.

It has now been found surprisingly that the action of such mediator compounds can be increased still further if they carry an anionic substituent.

Furthermore, other desirable features and characteristics of the present invention will become apparent from the subsequent detailed description of the invention and the appended claims, taken in conjunction with this background of the invention.

BRIEF SUMMARY OF THE INVENTION

A washing or cleaning agent, characterized in that it contains a mediator compound in the form of anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl.

Use of bleaching-active species, generated electrolytically by a redox reaction from anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl, to boost the cleaning power of washing and cleaning agents in an aqueous, particularly surfactant-containing bath.

A method for washing textiles or for cleaning hard surfaces, in particular for the machine cleaning of dishware, with use of a bleaching-active species, generated electrolytically by a redox reaction from anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

An object of the invention is the use of bleaching-active species, generated electrolytically by a redox reaction from anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl, to boost the cleaning power of washing and cleaning agents, in particular in regard to bleachable and/or protein-containing stains, in an aqueous, particularly surfactant-containing bath.

The anionic substituent in the 2,2,6,6-tetramethylpiperidine derivatives, essential to the invention, is preferably selected from the $SO_3^-$ group, $CO_2^-$ group, $PO_3^{2-}$ group, and mixtures thereof. The anionic substituent can be bound directly or preferably via a linker to a C atom of the piperidinyl ring. A linker is preferably selected from alkylene groups, aminoalkylene groups, oxyalkylene groups, aminocarbonylalkylene groups, oxycarbonylalkylene groups, each having 1 to 25 C atoms, and mixtures thereof. If desired, a molecule can also bear a number of anionic substituents; these can be located if desired on a linker or on a number of linkers. Countercations such as hydrogen, alkali metal, alkaline earth metal, and/or ammonium ions in a number balancing the negative charge of the anionic group or groups are present in the anionically substituted 2,2,6,6-tetramethylpiperidine derivative. Preferred 2,2,6,6-tetramethylpiperidine derivatives include those that bear an ester or amide compound at position 4, the anionic substituent being located on the molecular portion originating from the carboxylic acid. These are obtainable from 4-hydroxy- or 4-amino-2,2,6,6-tetramethylpiperidine-N-oxide or the corresponding hydroxylamine compounds or the corresponding oxyl radicals.

The bleaching-active species can be prepared in a simple manner by subjecting an aqueous system, containing the mediator compound, to an electrical potential difference applied between at least two electrodes, which is preferably 0.2 V to 5 V, in particular 1 V to 3 V, so that the mediator compound emits an electron. Without wishing to be bound to this theory, it is conceivable that a free-radical or N-oxoammonium species thus generated reaches the stain with the aqueous bath and removes an electron from the stain, and thereby a less-stained and/or more water-soluble and/or water-dispersible material is produced from the stain. The mediator compound is reconstituted from the bleaching-active species by reaction with the stain, so that there is a reversible redox system. It is possible to electrolyze the mediator compound-containing bath continuously or once or repeatedly for specific time periods of, for example, 10 minutes, 20 minutes, 30 minutes, 40 minutes, 50 minutes, or 60 minutes, it being possible to adjust the electrolysis duration to the degree of soiling of the laundry. The bleaching-active species can also be generated in that, in particular when a usual bleach dispensing apparatus is used, the mediator compound passes through an electrolysis device before admission into the chamber of a washing machine or dishwasher, in particular flows in aqueous solution or as a slurry through an electrolysis cell, which can be mounted in the inflow conduit inside or outside the machine. Alternatively, it is possible to allow other active substances, for example, enzymes, to perform their function in uninfluenced fashion at the beginning of the method, and only later to start the bleaching action by turning on the electrolysis device.

In a preferred embodiment of the invention, the electrolysis device is installed in a washing machine or dishwasher in the water-filled region of the washing or cleaning space, in the case of a drum-type washing machine preferably outside the washing drum. The device can be a permanently installed component of the washing machine or dishwasher, or a separate part. The electrolysis device, made in particular as an electrolysis cell, in a further embodiment of the invention is formed as a separate device independent of a washing machine or dishwasher, said device which is operated with its own power source, for example, a battery, (e-bleach ball). A further embodiment of the invention consists of integrating the electrolysis device in an additional water circuit within the machine. It is important in all embodiments that the electrodes of the electrolysis device can come into contact with the electrolyte (the washing or cleaning bath, or the supplied tap water) that contains the mediator compound, for example, when the e-bleach ball is located in the washing drum of a washing machine during the washing process.

Further subjects of the invention are a method for washing textiles and a method for cleaning hard surfaces, in particular for the machine cleaning of dishware, with use of a bleaching-active species, generated electrolytically by a redox reaction from anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl in the aqueous bath.

It is especially advantageous in this case that the activity of the bleach can be easily modified by regulating the current intensity, if desired, as a function of the degree of soiling or fabric. In textile washing processes, there is no damage to the thus treated textile, beyond that occurring when agents customary on the market are used.

In the context of the use of the invention and of the method of the invention, it is preferred if the concentration of the mediator compound in the aqueous washing or cleaning bath is 0.05 mmol/L to 5 mmol/L, in particular 0.1 mmol/L to 2 mmol/L. The use of the invention and the method of the invention are each preferably carried out at temperatures in the range of 10° C. to 95° C., in particular 20° C. to 40° C. The use of the invention and the method of the invention are each preferably carried out at pH values in the range of pH 2 to pH 12, in particular of pH 4 to pH 11.

The use of the invention or the method of the invention can be realized particularly easily by employing a washing or cleaning agent that contains the mediator compound. Washing agents for cleaning textiles and agents for cleaning hard surfaces, in particular dishwashing agents and among these preferably those for use in machines, said agents which contain a mediator compound in the form of an anionically substituted 1-hydroxy-2,2,6,6-tetramethylpiperidine, 2,2,6,6-tetramethylpiperidine-N-oxide, or (2,2,6,6-tetramethylpiperidin-1-yl)oxyl, apart from conventional ingredients compatible therewith, in particular a surfactant, are therefore further subjects of the invention. Although the success of the invention is already established by the electrolytic generation of the bleaching-active species, an agent of the invention can also additionally contain in particular a peroxygen-containing bleaching agent. It is particularly advantageous, however, that both the bleaching agent and conventional bleach activator can be omitted, so that as a result a smaller quantity of washing or cleaning agent needs to be used per washing or cleaning cycle. In a preferred embodiment, an agent of the invention is therefore free of a bleaching agent and conventional bleach activator.

Preferably, the agents of the invention contain 0.05% by weight to 10% by weight, in particular 0.1% by weight to 5% by weight of the mediator compound. When an agent of the invention is used, if desired, the cleaning-enhancing effect of the mediator compound can be eliminated by the complete omission of the electrolysis, if it is not to be used, for example, in only slightly stained laundry or extremely bleach-sensitive textiles. The consumer therefore needs only a single washing agent for washing insensitive, usually white, and sensitive, usually colored textiles.

The agents of the invention, which can be particularly powdered solids, in consolidated particle form, homogeneous solutions or suspensions, may contain in principle all known ingredients typical in such agents, in addition to the mediator compound to be used according to the invention. The agents of the invention can contain in particular builder substances, surface-active surfactants, water-miscible organic solvents, enzymes, sequestering agents, electrolytes, pH regulators, polymers with special effects, such as soil release polymers, color transfer inhibitors, graying inhibitors, crease-reducing polymeric active substances and shape-retaining polymeric active substances, bleaching agents, bleaching activators, and other aids, such as optical brighteners, foam regulators, dyes, and scents.

The agents of the invention can contain one or more surfactants; anionic surfactants, nonionic surfactants, and mixtures thereof may be used in particular, but cationic and/or amphoteric surfactants may also be present. Suitable nonionic surfactants are in particular alkyl glycosides and ethoxylation and/or propoxylation products of alkyl glycosides or linear or branched alcohols each having 12 to 18 C atoms in the alkyl part and 3 to 20, preferably 4 to 10 alkyl ether groups. Furthermore, corresponding ethoxylation and/or propoxylation products of N-alkylamines, vicinal diols, fatty acid esters, and fatty acid amides, which in terms of the alkyl part correspond to the aforesaid long-chain alcohol derivatives, and of alkyl phenols having 5 to 12 C atoms in the alkyl group can be used.

Suitable anionic surfactants are in particular soaps and those containing sulfate or sulfonate groups with preferably alkali ions as cations. Usable soaps are preferably the alkali salts of saturated or unsaturated fatty acids having 12 to 18 C atoms. Such fatty acids can also be used in incompletely neutralized form. The usable surfactants of the sulfate type include the salts of sulfuric acid half-esters of fatty alcohols having 12 to 18 C atoms and the sulfation products of the aforesaid nonionic surfactants with a low ethoxylation degree. The usable surfactants of the sulfonate type include linear alkylbenzene sulfonates having 9 to 14 C atoms in the alkyl portion, alkane sulfonates having 12 to 18 C atoms, and olefin sulfonates having 12 to 18 C atoms, which form upon reaction of corresponding monoolefins with sulfur trioxide, and alpha-sulfofatty acid esters, which form upon sulfonation of fatty acid methyl or ethyl esters.

Such surfactants are contained in the cleaning or washing agents of the invention in quantitative proportions of preferably 5% by weight to 50% by weight, in particular of 8% by weight to 30% by weight, whereas the disinfection agents of the invention as well as the cleaning agents of the invention preferably contain 0.1% by weight to 20% by weight, in particular 0.2% by weight to 5% by weight of surfactants.

The agents of the invention, particularly if they are the ones provided for the treatment of textiles, can contain as cationic active substances with a textile-softening effect in particular one or more of the cationic, textile-softening substances of the general formulas X, XI, or XII:

(X)

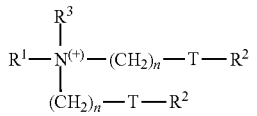

(XI)

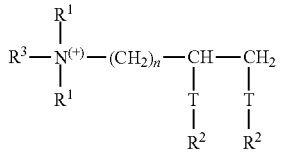

(XII)

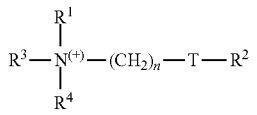

where each $R^1$ group independently of one another is selected from $C_{1-6}$ alkyl, alkenyl, or hydroxyalkyl groups; each $R^2$ group independently of one another is selected from $C_{8-28}$ alkyl or alkenyl groups; $R^3$═$R^1$ or $(CH_2)_n$-T-$R^2$; $R^4$═$R^1$ or $R^2$ or $(CH_2)_n$-T-$R^2$; T═$CH_2$—, —O—CO— or —CO—O—, and n is an integer from 0 to 5. The cationic surfactants have the usual anions in the type and number necessary for charge equalization, it being possible to select these, apart from, for example, halides, from anionic surfactants as well. In preferred embodiments of the present invention, hydroxyalkyltrialkylammonium compounds, in particular $C_{12-18}$ alkyl(hydroxyethyl)dimethylammonium compounds, and preferably the halides thereof, in particular chlorides, are used as cationic surfactants. An agent of the invention preferably contains 0.5% by weight to 25% by weight, in particular 1% by weight to 15% by weight of a cationic surfactant.

An agent of the invention preferably contains at least one water-soluble and/or water-insoluble, organic and/or inorganic builder. The water-soluble organic builder substances include polycarboxylic acids, in particular citric acid and sugar acids, monomeric and polymeric aminopolycarboxylic acids, in particular methylglycinediacetic acid, nitrilotriacetic acid, and ethylenediaminetetraacetic acid, as well as polyaspartic acid, polyphosphonic acids, in particular aminotris(methylenephosphonic acid), ethylenediaminetetrakis (methylenephosphonic acid), and 1-hydroxyethane-1,1-diphosphonic acid, polymeric hydroxy compounds such as dextrin, as well as polymeric (poly)carboxylic acids, in particular polycarboxylates obtainable by the oxidation of polysaccharides or dextrins, and/or polymeric acrylic acids, methacrylic acids, maleic acids, and mixed polymers thereof, which can also contain, polymerized into them, small proportions of polymerizable substances having no carboxylic acid functionality. The relative molecular mass of the homopolymers of unsaturated carboxylic acids is generally between 5000 and 200,000, and that of the copolymers between 2000 and 200,000, preferably 50,000 to 120,000, based in each case on the free acid. One particularly preferred acrylic acid/maleic acid copolymer has a relative molecular mass of 50,000 to 100,000. Suitable, albeit less preferred, compounds of this class are copolymers of acrylic acid or methacrylic acid with vinyl ethers, such as vinyl methyl ethers, vinyl esters, ethylene, propylene, and styrene, the acid fraction of which amounts to at least 50% by weight. Terpolymers containing as monomers two unsaturated acids and/or the salts thereof and, as a third monomer, vinyl alcohol and/or an esterified vinyl alcohol or a carbohydrate may also be used as water-soluble organic builder substances. The first acidic monomer or the salt thereof is derived from a monoethylenically unsaturated $C_3$-$C_8$ carboxylic acid and preferably from a $C_3$-$C_4$ monocarboxylic acid, in particular from (meth)acrylic acid. The second acid monomer or the salt thereof can be a derivative of a $C_4$-$C_8$ dicarboxylic acid, maleic acid being particularly preferred, and/or a derivative of an allylsulfonic acid, which is substituted in the 2-position with an alkyl or aryl group. Such polymers generally have a relative molecular mass between 1000 g/mol and 200,000 g/mol. Further preferred copolymers are those having acrolein and acrylic acid/acrylic acid salts or vinyl acetate as monomers. For the production of liquid agents in particular, the organic builder substances can be used in the form of aqueous solutions, preferably in the form of 30 to 50% by weight aqueous solutions. All the cited acids are generally used in the form of their water-soluble salts, in particular their alkali salts.

Such organic builder substances can be contained if desired in amounts of up to 40% by weight, in particular up to 25% by weight, and preferably of 1% by weight to 8% by weight. Amounts close to the cited upper limit are preferably used in paste-like or liquid, in particular aqueous, agents of the invention.

Suitable water-soluble inorganic builder materials in particular are polymeric alkali phosphates, which can be present in the form of their alkaline neutral or acidic sodium or potassium salts. Examples thereof are tetrasodium diphosphate, disodium dihydrogen diphosphate, pentasodium triphosphate, so-called sodium hexametaphosphate, and the corresponding potassium salts or mixtures of sodium and potassium salts. Crystalline or amorphous alkali aluminosilicates in particular in amounts of up to 50% by weight, preferably not above 40% by weight, and in liquid agents particularly of 1% by weight to 5% by weight, are used as water-insoluble, water-dispersible inorganic builder materials. Of these, the crystalline sodium aluminosilicates in detergent quality are preferred, in particular zeolite A, zeolite P, and optionally zeolite X. Amounts close to the cited upper limit are preferably used in solid, particulate agents. Suitable aluminosilicates have in particular no particles with a particle size greater than 30 μm and preferably consist of at least 80% by weight of particles with a size less than 10 μm. The calcium binding capacity thereof, which may be determined according to the information in German patent DE 2412837, is usually in the range of 100 to 200 mg of CaO per gram.

Suitable substitutes or partial substitutes for the aforesaid aluminosilicate are crystalline alkali silicates, which may be present alone or in a mixture with amorphous silicates. Alkali silicates that can be used as builders in the agents of the invention preferably have a molar ratio of alkali oxide to $SiO_2$ of less than 0.95, particularly of 1:1.1 to 1:12, and can be amorphous or crystalline. Preferred alkali silicates are sodium silicates, particularly amorphous sodium silicates, with a molar ratio of $Na_2O$: $SiO_2$ of 1:2 to 1:2.8. Crystalline phyllosilicates of the general formula $Na_2Si_xO_{2x+1}.yH_2O$, in which the so-called modulus x is a number from 1.9 to 4 and y is a number from 0 to 20, with preferred values for x being 2, 3, or 4, are preferably used as crystalline silicates, which can be present alone or in a mixture with amorphous silicates. Preferred crystalline phyllosilicates are those in which x assumes the values 2 or 3 in the aforesaid general formula. Both β- and δ-sodium disilicates ($Na_2Si_2O_5.yH_2O$) are preferred in particular. Virtually anhydrous crystalline alkali silicates prepared from amorphous alkali silicates and having the aforementioned general formula, in which x denotes a number from 1.9 to 2.1, can also be used in the agents of the invention. In a further preferred embodiment of the agents of the invention, a crystalline sodium phyllosilicate with a modulus of 2 to 3 is used, such as can be prepared from sand and soda. Crystalline sodium silicates with a modulus in the range of 1.9 to 3.5 are used in a further preferred embodiment of the agents of the invention. In a preferred embodiment of agents of the invention, a granular compound of alkali silicate and alkali carbonate is used, as is obtainable commercially under the name Nabion® 15, for example. If an alkali aluminosilicate, especially zeolite, is also present as an additional builder substance, the weight ratio of the aluminosilicate to silicate, based in each case on the anhydrous active substances, is preferably 1:10 to 10:1. In agents, which contain both amorphous and crystalline alkali silicates, the weight ratio of amorphous alkali silicate to crystalline alkali silicate is preferably 1:2 to 2:1 and particularly 1:1 to 2:1.

Builder substances are contained in the washing or cleaning agents of the invention preferably in amounts of up to 60% by weight, particularly of 5% by weight to 40% by weight.

In a preferred embodiment of the invention, an agent of the invention has a water-soluble builder block. The use of the term "builder block" here is intended to express the fact that the agents contain no builder substances other than those that are water-soluble; i.e., all builder substances contained in the agent are combined into the "block" thus characterized; an exception is made, at most, for the amounts of substances that may be present in commercially usual fashion as contaminants or as stabilizing additives in small amounts in the other ingredients of the agents. The term "water-soluble" is to be understood in this context to mean that the builder block dissolves without residue at the concentration resulting from the amount used of the agent containing it under usual conditions. Preferably, the agents of the invention contain at least 15% by weight and up to 55% by weight, in particular 25% by weight to 50% by weight of the water-soluble builder block. This is preferably made up of the components:

a) 5% by weight to 35% by weight of citric acid, alkali citrate, and/or alkali carbonate, which can also be replaced at least in part by alkali hydrogen carbonate,
b) up to 10% by weight of alkali silicate with a modulus in the range of 1.8 to 2.5,
c) up to 2% by weight of phosphonic acid and/or alkali phosphonate,
d) up to 50% by weight of alkali phosphate, and
e) up to 10% by weight of polymeric polycarboxylate, where the quantitative data refer to the total washing or cleaning agent. This also applies to all quantitative data hereafter, unless expressly stated otherwise.

In a preferred embodiment of agents of the invention, the water-soluble builder block contains at least 2 of the components b), c), d), and e) in amounts higher than 0% by weight.

With respect to component a), 15% by weight to 25% by weight of alkali carbonate, which can be replaced at least in part by alkali hydrogen carbonate, and up to 5% by weight, in particular 0.5% by weight to 2.5% by weight of citric acid and/or alkali citrate are contained in a preferred embodiment of the agents of the invention. In an alternative embodiment of agents of the invention, 5% by weight to 25% by weight, in particular 5% by weight to 15% by weight of citric acid and/or alkali citrate and up to 5% by weight, in particular 1% by weight to 5% by weight of alkali carbonate, which can be replaced at least in part by alkali hydrogen carbonate, are contained as component a). If both alkali carbonate and alkali hydrogen carbonate are present, component a) has alkali carbonate and alkali hydrogen carbonate preferably in the weight ratio of 10:1 to 1:1.

With respect to component b), 1% by weight to 5% by weight of alkali silicate with a modulus in the range of 1.8 to 2.5 is contained in a preferred embodiment of agents of the invention.

With respect to component c), 0.05% by weight to 1% by weight of phosphonic acid and/or alkali phosphonate is contained in a preferred embodiment of agents of the invention. Phosphonic acids in this context are also understood to be optionally substituted alkyl phosphonic acids, which may have a number of phosphonic acid groups (so-called polyphosphonic acids). They are preferably selected from the hydroxy- and/or aminoalkylphosphonic acids and/or alkali salts thereof such as, for example, dimethylaminomethanediphosphonic acid, 3-aminopropane-1-hydroxy-1,1-diphosphonic acid, 1-amino-1-phenylmethane-diphosphonic acid, 1-hydroxyethane-1,1-diphosphonic acid, amino-tris(methylenephosphonic acid), N,N,N',N'-ethylene-diaminetetrakis(methylenephosphonic) acid, and acylated derivatives of phosphoric acid, which can also be used in any desired mixtures.

With respect to component d), 15% by weight to 35% by weight of alkali phosphate, in particular trisodium polyphosphate, is contained in a preferred embodiment of the agents of the invention. Alkali phosphate here is the collective term for the alkali metal (particularly sodium and potassium) salts of the various phosphoric acids, it being possible to distinguish metaphosphoric acids $(HPO_3)_n$ and orthophosphoric acid $H_3PO_4$, in addition to higher-molecular-weight representatives. The phosphates combine several advantages: they act as alkali carriers, prevent lime deposits on machine parts or lime incrustations in fabrics and, moreover, contribute to the cleaning power. Sodium dihydrogen phosphate, $NaH_2PO_4$, exists as a dihydrate (density of 1.91 $gcm^{-3}$, melting point 60°) and as a monohydrate (density of 2.04 $gcm^{-3}$). Both salts are white powders, very readily soluble in water, which lose their water of crystallization upon heating and at 200° C. transition into the weakly acidic diphosphate (disodium hydrogen diphosphate, $Na_2H_2P_2O_7$), and at higher temperature into sodium trimetaphosphate ($Na_3P_3O_9$) and Madrell's salt. $NaH_2PO_4$ reacts acidically; it is formed when phosphoric acid is adjusted to a pH of 4.5 with sodium hydroxide solution and the mash is sprayed. Potassium dihydrogen phosphate (primary or monobasic potassium phosphate, potassium diphosphate, KDP), $KH_2PO_4$, is a white salt with a density of 2.33 $gcm^{-3}$, has a melting point of 253° C. (decomposing with the formation of $(KPO_3)_x$, potassium polyphosphate), and is readily soluble in water. Disodium hydrogen phosphate (secondary sodium phosphate), $Na_2HPO_4$, is a colorless, very readily water-soluble crystalline salt. It exists anhydrously and with 2 mol (density of 2.066 $gcm^{-3}$, water loss at 95° C.), 7 mol (density of 1.68 $gcm^{-3}$, melting point 48° C. with loss of 5 $H_2O$), and 12 mol of water (density of 1.52 $gcm^{-3}$, melting point 35° C. with loss of 5 $H_2O$), is anhydrous at 100° C. and when heated more greatly converts to the diphosphate $Na_4P_2O_7$. Disodium hydrogen phosphate is prepared by neutralizing phosphoric acid with a soda solution with use of phenolphthalein as an indicator. Dipotassium hydrogen phosphate (secondary or dibasic potassium phosphate), $K_2HPO_4$, is an amorphous, white salt, which is readily soluble in water. Trisodium phosphate, tertiary sodium phosphate, $Na_3PO_4$, constitutes colorless crystals, which as the dodecahydrate have a density of 1.62 $gcm^{-3}$ and a melting point of 73-76° C. (decomposition), as the decahydrate (corresponding to 19-20% $P_2O_5$) a melting point of 100° C., and in anhydrous form (corresponding to 39-40% $P_2O_5$) a density of 2.536 $gcm^{-3}$. Trisodium phosphate is readily soluble in water with an alkaline reaction and is prepared by evaporating a solution of precisely 1 mol of disodium phosphate and 1 mol of NaOH. Tripotassium phosphate (tertiary or tribasic potassium phosphate), $K_3PO_4$, is a white, deliquescent, granular powder with a density of 2.56 $gcm^{-3}$; it has a melting point of 1340° C. and is readily soluble in water with an alkaline reaction. It forms, e.g., upon heating of basic slag with carbon and potassium sulfate. Despite the higher price, the more readily soluble, therefore highly effective, potassium phosphates are frequently preferred over the corresponding sodium compounds. Tetrasodium diphosphate (sodium pyrophosphate), $Na_4P_2O_7$, exists in anhydrous form (density of 2.534 $gcm^{-3}$, melting point of 988° C., also given as 880° C.) and as the decahydrate (density of 1.815-1.836 $gcm^{-3}$, melting point of 94° C. with loss of water). Both substances are colorless crystals, readily soluble in water with an alkaline reaction. $Na_4P_2O_7$ forms upon heating of disodium phosphate to >200° C. or by reacting phosphoric acid with soda in the stoichiometric ratio and dewatering the solution by spraying. The decahydrate complexes heavy metal salts and hardness builders and therefore reduces the hardness of the water. Potassium diphosphate (potassium pyrophosphate), $K_4P_2O_7$, exists in the form of the trihydrate and represents a colorless, hygroscopic powder with a density of 2.33 $gcm^{-3}$, which is soluble in water, the pH of the 1% solution being 10.4 at 25° C. Condensation of $NaH_2PO_4$ or $KH_2PO_4$ yields higher-molecular-weight sodium and potassium phosphates, with the differentiation of cyclic representatives (the sodium or potassium metaphosphates) and chain types (the sodium or potassium polyphosphates). Many names are used in particular for the last-mentioned compounds: fused or calcined phosphates, Graham's salt, Kurrol's and Madrell's salt. All higher sodium and potassium phosphates together are referred to as condensed phosphates. The technically important pentasodium triphosphate, $Na_5P_3O_{10}$ (sodium tripolyphosphate), is a non-hygroscopic, white, water-soluble salt of the general formula NaO—[P(O)(ONa)—O]$_n$—Na with n=3, which is anhydrous or crystallizes with 6 $H_2O$. About 17 g of the salt, free of water of crystallization, dissolves in 100 g of water at room temperature, about 20 g at 60° C., and approximately 32 g at 100° C.; after the solution is heated for 2 hours to 100° C., about 8% orthophosphate and 15% diphosphate form by hydrolysis. In the preparation of pentasodium triphosphate, phosphoric acid is reacted with soda solution or sodium hydroxide solution in the stoichiometric ratio and the solution is dewatered by spraying. Like Graham's salt and sodium diphosphate, pentasodium triphosphate dissolves many insoluble metal compounds (including lime soaps). Pentapotassium triphosphate, $K_5P_3O_{10}$ (potassium tripolyphosphate), is placed on the market, for example, in the form a 50% by weight solution (≥23% $P_2O_5$, 25% $K_2O$). The potassium polyphosphates are widely used in the washing agent and cleaning agent industry. Further, there are also sodium potassium tripolyphosphates, which can also be used in the context of the present invention. These are formed, for example, when sodium trimetaphosphate is hydrolyzed with KOH:

$$(NaPO_3)_3+2\ KOH \rightarrow Na_3K_2P_3O_{10}+H_2O$$

These can be used in the same way as sodium tripolyphosphate, potassium tripolyphosphate, or mixtures of both of these; mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate are also usable according to the invention.

With respect to component e), 1.5% by weight to 5% by weight of polymeric polycarboxylate, in particular selected from the polymerization or copolymerization products of acrylic acid, methacrylic acid, and/or maleic acid, is contained in a preferred embodiment of the agent of the invention. Among these, the homopolymers of acrylic acid and among these in turn those with an average molar mass in the range of 5000 D to 15,000 D (PA standard) are particularly preferred.

Suitable enzymes usable in the agents are those from the class of proteases, lipases, cutinases, amylases, pullulanases, mannanases, cellulases, hemicellulases, xylanases, oxidases, and peroxidases, and mixtures thereof, for example, proteases such as BLAP®, Optimase®, Opticlean®, Maxacal®, Maxapem®, Alcalase®, Esperase®, Savinase®, Durazym®, and/or Purafect® OxP, amylases such as Termamyl®, Amylase-LT®, Maxamyl®, Duramyl®, and/or Purafect® OxAm, lipases such as Lipolase®, Lipomax®, Lumafast®, and/or Lipozym®, and cellulases such as Celluzyme® and/or Carezyme®. Enzymatic active substances obtained from fungi or bacteria are especially suitable, for example, *Bacillus subtilis, Bacillus licheniformis, Streptomyces griseus, Humicola lanuginosa, Humicola insolens, Pseudomonas pseudoalcaligenes*, or *Pseudomonas cepacia*. The optionally employed enzymes may be adsorbed onto supports and/or encapsulated in shell-forming substances to protect them from premature inactivation. They are contained in the washing, cleaning, and disinfecting agents of the invention preferably in amounts up to 10% by weight, in particular of 0.2% by weight to 2% by weight, enzymes stabilized against oxidative degradation being used particularly preferably.

In a preferred embodiment of the invention, the agent contains 5% by weight to 50% by weight, in particular 8-30% by weight of anionic and/or nonionic surfactant, up to 60% by weight, in particular 5-40% by weight of a builder substance, and 0.2% by weight to 2% by weight of enzyme, selected from the proteases, lipases, cutinases, amylases, pullulanases, mannanases, cellulases, oxidases, and peroxidases, as well as mixtures thereof.

Suitable peroxygen compounds, optionally present in the agents, which preferably can be omitted, however, in the agents provided for use in the method of the invention, are in particular organic peracids or peracid salts of organic acids, such as phthalimidopercaproic acid, perbenzoic acid, or salts of the diperdodecanoic diacid, hydrogen peroxide, and inorganic salts that release hydrogen peroxide under washing conditions, such as perborate, percarbonate, and/or persilicate. In this regard, hydrogen peroxide can also be generated with the aid of an enzymatic system, i.e., an oxidase and its substrate. If solid peroxygen compounds are to be used, they may be used in the form of powders or granules, which may also be encapsulated in a manner known in principle. Alkali percarbonate, alkali perborate monohydrate, alkali perborate tetrahydrate, or hydrogen peroxide in the form of aqueous solutions, containing 3% by weight to 10% by weight of hydrogen peroxide, are used especially preferably. If desired, peroxygen compounds are present in amounts of up to 50% by weight, in particular of 5% by weight to 30% by weight, in the washing or cleaning agents of the invention.

In addition, conventional bleach activators, which form peroxocarboxylic acids or peroxoimidic acids under perhydrolysis conditions, and/or conventional bleach-activating transition metal complexes can be used. The bleach activator component that is optionally present, particularly in amounts of 0.5% by weight to 6% by weight, comprises the usually employed N- or O-acyl compounds, for example, polyacylated alkylenediamines, particularly tetraacetylethylenediamine, acylated glycolurils, particularly tetraacetylglycoluril, N-acylated hydantoins, hydrazides, triazoles, urazoles, diketopiperazines, sulfurylamides, and cyanurates, in addition carboxylic acid anhydrides, particularly phthalic anhydride, carboxylic acid esters, particularly sodium isononanoyl phenolsulfonate, and acylated sugar derivatives, particularly pentaacetyl glucose, and cationic nitrile derivatives such as trimethylammonium acetonitrile salts. In order to prevent interaction with the per-compounds during storage, the bleach activators can be coated with coating substances or granulated in known fashion; tetraacetylethylenediamine granulated with the aid of carboxymethylcellulose and with average particle sizes of 0.01 mm to 0.8 mm, granulated 1,5-diacetyl-2,4-dioxohexahydro-1,3,5-triazine, and/or trialkylammonium acetonitrile formulated in particle form are particularly preferred. Washing or cleaning agents contain bleach activators of this kind preferably in amounts up to 8% by weight, particularly of 2% by weight to 6% by weight, based in each case on the total agent.

Organic solvents that can be used in agents of the invention, particularly if they are in liquid or pasty form, include alcohols having 1 to 4 C atoms, particularly methanol, ethanol, isopropanol, and tert-butanol, diols having 2 to 4 C atoms, particularly ethylene glycol and propylene glycol, and mixtures thereof, and ethers derivable from the aforesaid classes of compounds. Water-miscible solvents of this kind are present in the washing agents of the invention preferably in amounts not exceeding 30% by weight, in particular of 6% by weight to 20% by weight.

In order to establish a desired pH that does not result of itself from the mixture of the other components, the agents of the invention can contain system-compatible and environmentally compatible acids, in particular citric acid, acetic acid, tartaric acid, malic acid, lactic acid, glycolic acid, succinic acid, glutaric acid, and/or adipic acid, but also mineral acids, in particular sulfuric acid, or bases, in particular ammonium or alkali hydroxides. pH regulators of this kind are contained in the agents of the invention in amounts preferably not above 20% by weight, particularly of 1.2% by weight to 17% by weight.

Soil-release-enabling polymers, which are often referred to as "soil release" active substances, or as "soil repellents" because of their ability to make the treated surface (for example, of the fibers) soil-repellent, are, for example, nonionic or cationic cellulose derivatives. The particularly polyester-active soil-release-enabling polymers include copolyesters of dicarboxylic acids, for example, adipic acid, phthalic acid, or terephthalic acid, diols, for example, ethylene glycol or propylene glycol, and polydiols, for example, polyethylene glycol or polypropylene glycol. The soil-release-enabling polyesters preferred for use include compounds that are obtainable formally by esterification of two monomer parts, the first monomer being a dicarboxylic acid HOOC-Ph-COOH and the second monomer being a diol $HO—(CHR^{11}—)_aOH$, which can also be present as a polymeric diol $H—O—(CHR^{11}—)_a)_bOH$. Ph therein denotes an o-, m-, or p-phenylene group which may bear 1 to 4 substituents selected from alkyl groups having 1 to 22 C atoms, sulfonic acid groups, carboxyl groups, and mixtures thereof, $R^{11}$ denotes hydrogen, an alkyl group having 1 to 22 C atoms, and mixtures thereof, 'a' denotes a number from 2 to 6, and 'b' a number from 1 to 300. The polyesters obtainable therefrom preferably contain both monomeric diol units $—O—(CHR^{11}—)_aO—$ and polymeric diol units $—O—(CHR^{11}—)_a)_bO—$. The molar ratio of monomeric diol units to polymeric diol units is preferably 100:1 to 1:100, particularly 10:1 to 1:10. The degree of polymerization 'b' in the polymeric diol units is preferably in the range of 4 to 200, in particular 12 to 140. The molecular weight or the average molecular weight or the maximum of the molecular weight distribution of preferred soil-release-enabling polyesters is in the range of 250 to 100,000, in particular 500 to 50,000. The acid forming the basis for the Ph group is preferably selected from terephthalic acid, isophthalic acid, phthalic acid, trimellitic acid, mellitic acid, the isomers of sulfophthalic acid, sulfoisophthalic acid, and sulfoterephthalic acid, and mixtures thereof. Provided the acid groups thereof are not part of the ester bonds in the polymer, they are preferably present in the form of a salt, particularly an alkali or ammonium salt. Among these, the sodium and potassium salts are particularly preferred. If desired, instead of the HOOC-Ph-COOH monomer, small portions, in particular no more than 10 mol %, based on the content of Ph having the meaning stated above, of other acids which have at least two carboxyl groups may be contained in the soil-release-enabling polyester. These include, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Among the polymeric diols, polyethylene glycol, having an average molar mass in the range of 1000 to 6000, is particularly preferred. If desired, these polyesters may also be end-capped, alkyl groups having 1 to 22 C atoms and esters of monocarboxylic acids being suitable end groups. Polymers of ethylene terephthalate and polyethylene oxide terephthalate, in which the polyethylene glycol units have molecular weights of 750 to 5000 and the molar ratio of ethylene terephthalate to polyethylene oxide terephthalate is 50:50 to 90:10, are used preferably alone or in combination with cellulose derivatives.

Color transfer inhibitors that are suitable for use in the agents of the invention for washing textiles include in particular polyvinylpyrrolidones, polyvinylimidazoles, polymeric N-oxides such as poly(vinylpyridine-N-oxide), and copolymers of vinylpyrrolidone with vinylimidazole, and optionally further monomers.

The agents of the invention for use in textile laundering may contain anti-creasing agents, because textile fabrics, in particular, made of rayon, wool, cotton, and mixtures thereof, can tend to wrinkle, because the individual fibers are susceptible to bending, kinking, compression, and squeezing perpendicular to the fiber direction. These include, for example, synthetic products based on fatty acids, fatty acid esters, fatty acid amides, fatty acid alkylol esters, fatty acid alkylolamides, or fatty alcohols, usually reacted with ethylene oxide, or products based on lecithin or modified phosphoric acid esters.

Graying inhibitors have the task of keeping dirt, released from the hard surface and in particular from the textile fiber, suspended in the bath. Water-soluble colloids of a mainly organic nature are suitable for this purpose, for example, starch, size, gelatin, salts of ether carboxylic acids or ether sulfonic acids of starch or cellulose or salts of acidic sulfuric acid esters of cellulose or starch. Water-soluble polyamides containing acid groups are also suitable for this purpose. Derivatives of starch other than those stated above, for example, aldehyde starches, may be used furthermore. Preference is given to cellulose ethers such as carboxymethylcellulose (Na salt), methyl cellulose, hydroxyalkyl cellulose, and mixed ethers such as methyl hydroxyethyl cellulose, methyl hydroxypropyl cellulose, methyl carboxymethyl cellulose, and mixtures thereof, for example, in amounts of 0.1 to 5% by weight, based on the agents.

The agents can contain optical brighteners, among these in particular derivatives of diaminostilbenedisulfonic acid or alkali metal salts thereof. Suitable are, for example, salts of 4,4'-bis(2-anilino-4-morpholino-1,3,5-triazinyl-6-amino) stilbene-2,2'-disulfonic acid or compounds of similar structure that carry, instead of the morpholino group, a diethanolamino group, a methylamino group, an anilino group, or a 2-methoxyethylamino group. Brighteners of the substituted diphenylstyryl type furthermore may be present, for example, the alkali salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the aforementioned optical brighteners may also be used.

Especially for use in machine washing or cleaning processes, it may be advantageous to add conventional foam inhibitors to the agents. Suitable foam inhibitors are, for example, soaps of natural or synthetic origin, which have a high proportion of $C_{18}$-$C_{24}$ fatty acids. Suitable nonsurfactant foam inhibitors are, for example, organopolysiloxanes and mixtures thereof with microfine, optionally silanized silicic acid, as well as paraffins, waxes, microcrystalline waxes, and mixtures thereof with silanized silicic acid or bis-fatty acid alkylenediamides. Mixtures of different foam inhibitors are also used advantageously, for example, mixtures of silicones, paraffins, or waxes. The foam inhibitors, in particular foam inhibitors containing silicone and/or paraffin, are preferably bound to a granular carrier substance soluble or dispersible in water. Mixtures of paraffins and distearyl ethylene diamide are particularly preferred here.

Active substances for preventing the tarnishing of objects made of silver, so-called silver corrosion inhibitors, can be used in addition in agents of the invention. Preferred silver corrosion protection agents are organic disulfides, dihydric phenols, trihydric phenols, optionally alkyl- or aminoalkyl-substituted triazoles such as benzotriazole, and salts and/or complexes of cobalt, manganese, titanium, zirconium, hafnium, vanadium, or cerium in which the aforesaid metals are present in one of the oxidation states II, III, IV, V, or VI.

The production of solid agents of the invention presents no difficulties and can occur in a manner known in principle, for example, by spray-drying or granulation. A method having an extrusion step is preferable for producing agents of the invention with an elevated bulk weight, particularly in the range of 650 g/L to 950 g/L. Washing, cleaning, or disinfecting agents in the form of solutions containing aqueous or other conventional solvents are produced especially advantageously by simple mixing of the ingredients, which can be added in bulk or as a solution into an automatic mixer. In a preferred embodiment of agents, in particular, for the machine cleaning of dishware, said agents are in tablet form.

EXAMPLES

Example 1

A solution of 5.14 g (30 mmol) of 4-amino-2,2,6,6-tetramethylpiperidine-N-oxide in 125 mL of dichloromethane was added dropwise under argon over 45 minutes to 7.22 g (37 mmol) of 6-bromohexanoic acid in 10 mL of dichloromethane. After 15 minutes of additional stirring, 8.87 g (43 mmol) of N,N'-dicyclohexylcarbodiimide and 0.45 g (3.7 mmol) of 4-dimethylaminopyridine were added. The mixture was stirred for 16 hours at room temperature. Next, the mixture was filtered and the solution was concentrated. The obtained residue (15 g) was taken up in 100 mL of ethyl acetate, washed with 100 mL of 5% hydrochloric acid, then twice each time with 50 mL of ice water, next twice each time with 50 mL of saturated sodium hydrogen carbonate solution, and lastly with 50 mL of saturated sodium chloride solution.

Obtained was 8.38 g of 4-[(6-bromohexanoyl)amino]-2,2,6,6-tetramethylpiperidin-1-yl-oxyl as the crude product, which was dissolved in 150 mL of ethanol without further purification. A solution of 3.14 g of sodium sulfite (25 mmol) in 50 mL of demineralized water was added dropwise over 5 minutes. Next, the mixture was stirred for another 3 hours at 70° C. After cooling to room temperature, the reaction mixture was filtered and concentrated, and 9.7 g of a crude product was isolated. The product was purified by column chromatography (solvent: dichloromethane/methanol 5:1), with a yield of 4.37 g of 4-[(6-sulfohexanoyl)amino]-2,2,6,6-tetramethylpiperidin-1-yl-oxyl (T1) as a yellow solid.

Example 2

A 2-millimolar aqueous solution of T1 prepared in Example 1, which in addition contained 0.1 mol/L of $Na_2SO_4$ and in which the cotton substrates were placed, which had been provided with a standardized blueberry stain (A1) or a standardized tea stain (A2), was electrolyzed at 40° C. and pH 5 to 6 with a potential difference of 1.35 V (Ag/AgCl) with use of a graphite working electrode and a graphite counter electrode; the anolyte and catholyte were separated by a frit, the stained cotton substrate was located in the anode compartment, and the convection in the solution was supported by the use of a magnetic stirrer. Next, the cotton substrates were removed, rinsed with ultrapure water, pressed for drying between laboratory paper, and their lightness (L* value) was determined. The thus obtained lightness values (+E)—and for comparison, those obtained in an otherwise identical process but without application of a potential difference (−E)—are listed in Table 1. No difference relative to the values for −E was obtained, if the otherwise identical tests were performed with application of the potential difference but without the TEMPO derivative.

TABLE 1

| | Lightness values | |
|---|---|---|
| | +E | −E |
| Stain A1 | 75.35 | 74.01 |
| Stain A2 | 83.69 | 81.33 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for washing textiles or for cleaning hard surfaces, wherein the textiles or hard surfaces are contacted with a bleaching-active species, generated electrolytically by a redox reaction in an electrolysis device from anionically substituted 1-hydroxy-2,2,6,6-tetramethylpiperidine, 2,2,6,6-tetra-methylpiperidine-N-oxide, or (2,2,6,6-tetramethylpiperidin-1-yl)oxyl, wherein the anionic substitutent comprises an ester or amide at position 4 of the piperidine ring, in an aqueous bath.

2. The method according to claim 1, characterized in that the bath containing the mediator compound is electrolyzed continuously or once or repeatedly for specific time periods.

3. The method according to claim 1, characterized in that the electrolysis device is formed as a separate device independent of a washing machine or dishwasher, and said device operates on its own power source.

4. The method according to claim 1, characterized in that the mediator compound passes through an electrolysis device before admission into the chamber of a washing machine and flows in aqueous solution or as a slurry through an electrolysis cell.

5. The method according claim 1, wherein the concentration of the mediator compound in the aqueous washing or cleaning bath is 0.05 mmol/L to 5 mmol/L.

* * * * *